United States Patent [19]

Mueller et al.

[11] 3,976,181

[45] Aug. 24, 1976

[54] TYPING MACHINE REPEAT KEY ACTION

[75] Inventors: Hans W. Mueller, Cortland; Howard F. Sherman, McGraw; Richard E. Shattuck, Cortland, all of N.Y.

[73] Assignee: SCM Corporation, New York, N.Y.

[22] Filed: Aug. 28, 1974

[21] Appl. No.: 501,123

[52] U.S. Cl. ..... 197/17

[51] Int. Cl.[2] ..... B41J 23/06

[58] Field of Search ..... 197/17, 33

[56] References Cited

UNITED STATES PATENTS

| | | | |
|---|---|---|---|
| 2,714,948 | 8/1955 | Schremp et al. | 197/17 |
| 2,723,740 | 11/1955 | Toeppen | 197/17 |
| 2,798,584 | 7/1957 | Kennedy | 197/17 |
| 3,001,625 | 9/1961 | Cetran et al. | 197/17 |
| 3,342,295 | 9/1967 | Hishida | 197/17 |
| 3,419,123 | 12/1968 | Salzberger et al. | 197/17 |
| 3,623,587 | 11/1971 | Link | 197/17 |
| 3,638,775 | 2/1972 | Hishida et al. | 197/17 |
| 3,706,366 | 12/1972 | Hishida et al. | 197/17 |
| 3,738,470 | 6/1973 | Osaka | 197/17 |

*Primary Examiner*—Wm. H. Grieb
*Attorney, Agent, or Firm*—Kenneth W. Greb; Milton M. Wolson

[57] ABSTRACT

A gap is provided between two teeth on a power roll in a typing machine repeat key action, and a cam follower surface is provided on a repeat interposer. A repeat typing operation can be initiated only when the cam follower surface engages the gap. When the key action is not in a repeat position, a latch and a forked lever cooperate to hold the repeat interposer away from the power roll; when the key action is in the repeat position, the forked lever holds a single-action interposer out of the way. The gap prevents skipped and uneven repeat typing operations during high-speed operation by giving the actuator and the typebar enough time to settle into rest position.

15 Claims, 7 Drawing Figures

TYPING MACHINE REPEAT KEY ACTION

BACKGROUND OF THE INVENTION

1. Field of the Invention

This invention relates to repeat key actions for power driven typing machines and more particularly to the timing of repeat typing operations and means for holding a repeat interposer away from the power roll.

2. Description of the Prior Art

Prior typing machine repeat key actions have a number of disadvantages. For example, the repeat timing is unregulated. The key action repeats whenever a preceding typing operation is completed. In the prior art, attempts have been made to attain higher typing speeds which have resulted in specific problems that include skipped and uneven typing operations because the pawl that initiates typing operations does not have enough time to fully engage the power roll. In addition, the repeat speed, in prior art devices, varies with the location of the key action in a typing machine. An upper bank underline repeats at a different speed than a lower bank period because of the different positions of the typebars in the typebar segment.

SUMMARY OF THE INVENTION

It is, therefore, an object of the invention to provide a repeat key action in which the repeat timing is regulated.

Another object of the invention is to provide a repeat key action that performs with substantially the same characteristics wherever the repeat key action is located in a typing machine.

Another object of the invention is to provide a repeat key action in which the single-action interposer cannot interfere with repeat typing machine operations and is positively restrained.

Another object of the invention is to provide a repeat key action in which the repeat interposer will not chatter against teeth on a power roll during depression of the key.

A still further object of the invention is to provide a repeat key action in which vibrations are not transmitted back to the key during repeat typing machine operations.

In order to accomplish the objects of the invention, a gap is provided between two teeth on a power roll in a typing machine repeat key action, and a cam follower surface is provided on a repeat interposer. A repeat typing operation can be initiated only when the cam follower surface engages the gap. When the key action is not in a repeat position, a latch and a forked lever cooperate to hold the repeat interposer away from the power roll so that the repeat interposer cannot chatter against teeth on the power roll. When the key action is in the repeat position, the forked-lever holds a single-action interposer out of the way. The gap prevents skipped and uneven repeat typing operations in high-speed operation by giving the actuator and the typebar enough time to settle into rest position. In addition, the gap enables the repeat key action to repeat at the same speed no matter where the repeat key action is located in the typing machine. During repeat typing operations, the repeat interposer is connected to the rest of the key action by only a tension spring between the repeat interposer and the latch. Therefore, vibrations cannot be transmitted back to a key on the key lever. Most of the moving parts can be stamped inexpensively from sheet metal.

Other objects and a fuller understanding of the invention can be had by referring to the description of the preferred embodiment and the claims, taken in conjunction with the accompanying drawing as hereinafter described.

BRIEF DESCRIPTION OF THE DRAWING

FIG. 6 is a view similar to that of FIG. 5 with the key action partially restored toward the rest position.

DESCRIPTION OF THE PREFERRED EMBODIMENT

Figure 1:
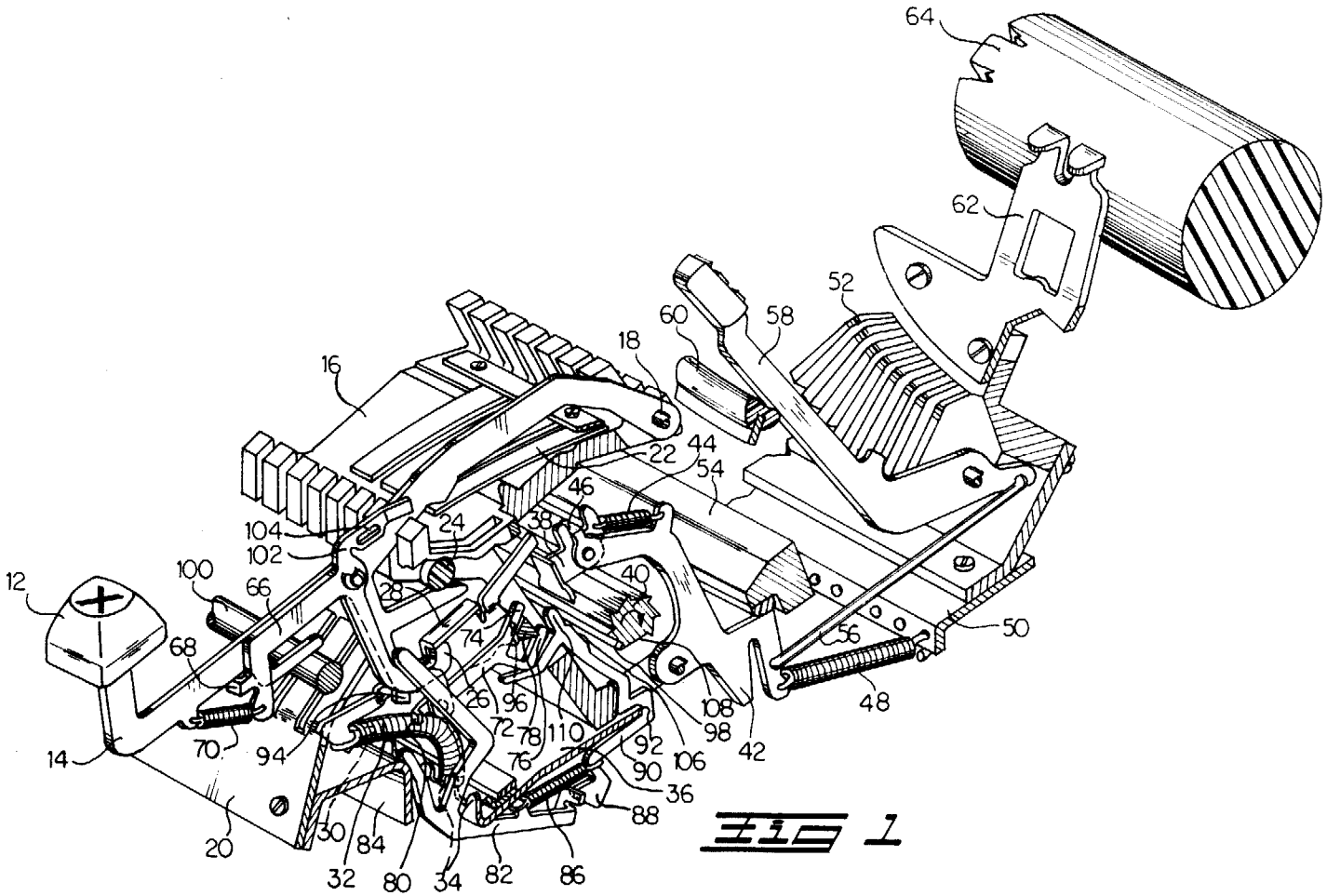
FIG. 1 is a perspective view of a portion of a typing machine embodying the invention.

With initial reference to FIG. 1 of the drawing, the invention is shown embodied in a repeat key action in a typing machine represented by portions selected for their cooperative relevance to the invention. The term "typing machine" as used herein applies to any one of many different kinds of machines such as typewriters, ball printers, printers for computers, teletypewriters, adding machines, calculators, cash registers, and the like.

As shown in FIG. 1, the key action (omitting temporarily the repeat portion) includes a key 12 mounted on a key lever 14 that is pivotally connected to a key lever support comb 16 by a pivot pin 18 and vertically guided by a key lever guide comb 20. A cantilever flat spring 22 mounted on the key lever support comb 16 biases the key lever 14 upward against a stop 24 on the key lever support comb 16. The stop 24 is composed of vinyl plastic or other suitable material.

A nose 26 on the key lever 14 engages a single-action interposer 28, while a prong 30 on the single-action interposer 28 extends into an arcuate coil spring 32. The arcuate coil spring 32 is straight when disassembled. The arcuate coil spring 32 is impaled on a spike 34 on a plate 36 that is connected to the key lever support comb 16.

The single-action interposer 28 is poised above a pawl 38 that is positioned to engage a rotor in the form of a power roll 40. The pawl 38 is pivotally connected to an actuator 42 that in turn is pivotally connected to the key lever support comb 16. A coil tension spring 44 connected between the pawl 38 and the actuator 42 biases the pawl 38 clockwise against a bent ear 46 on the actuator 42, while a coil tension spring 48 connected between the actuator 42 and a bracket 50 on a typebar segment 52 biases the actuator 42 against an actuator stop bar 54. A link 56 pivotally connects the actuator 42 to a typebar 58 that in turn is pivotally connected to the typebar segment 52 and is normally disposed against a typebar rest 60. When actuated, the typebar 58 (guided by a typebar guide 62 mounted on the typebar segment 52) strikes a platen 64. Although the key action has been described in the singular, a complete typing machine could have as many as 44 or more key actions. The key lever support comb 16, key lever guide comb 20, and typebar segment 52 help guide and prevent lateral movement of the key action.

The repeat portion of the key action includes a bell crank 66 pivotally connected to the key lever 14 with a bent projection 68 on the bell crank 66 biased against the key lever 14 by a coil tension spring 70 connected between the bell crank 66 and the key lever 14. A forked lever 72 in turn is pivotally connected to the bell crank 66. The forked lever 72 has upper and lower prongs 74 and 76 pivotally embracing a shelf 78, and a bent projection 80 for engaging a latch 82 that is pivotally mounted between two spikes 34 on the plate 36 and rests against a latch stop wall 84 connected to the key lever guide comb 20. A coil tension spring 86 connects the latch 82 to the front end 88 of a repeat interposer 90 that is pivotally mounted over the rear edge 92 of the plate 36. The repeat interposer 90 is held in rest position by the lower prong 76 of the forked lever 72.

Figure 2:
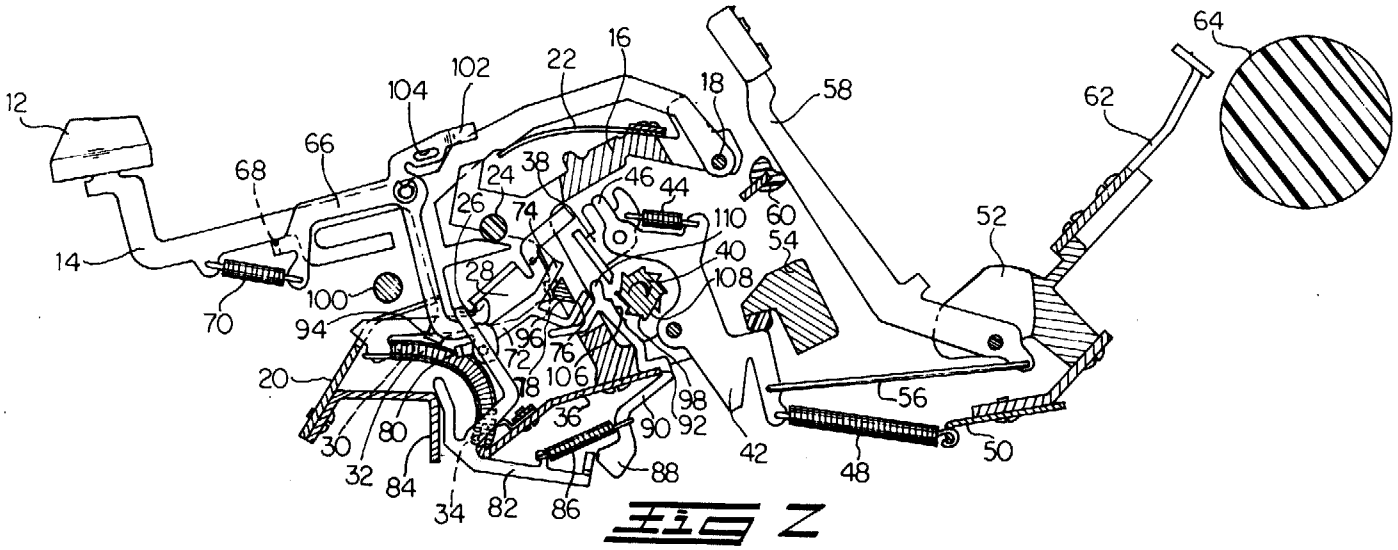
FIG. 2 is a right side elevation view of the typing machine shown in FIG. 1 with the key action in rest position.

FIGS. 2 to 6 represent successive steps during a repeat typing operation. Other repeat typing machine operations are also possible using the invention such as spacing and so forth. For completeness, FIG. 2 shows the repeat key action in rest position as in FIG. 1.

Figure 3:
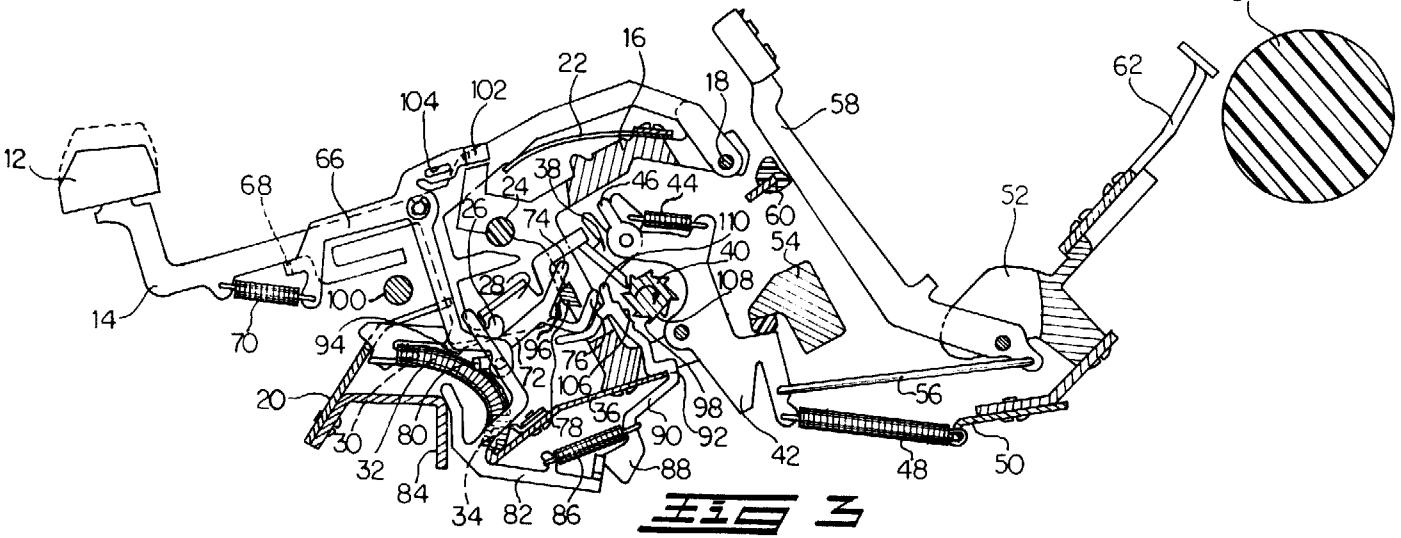
FIG. 3 is a view similar to that of FIG. 2 just after tripping of the key action to initiate a single typing operation.
Figure 4:
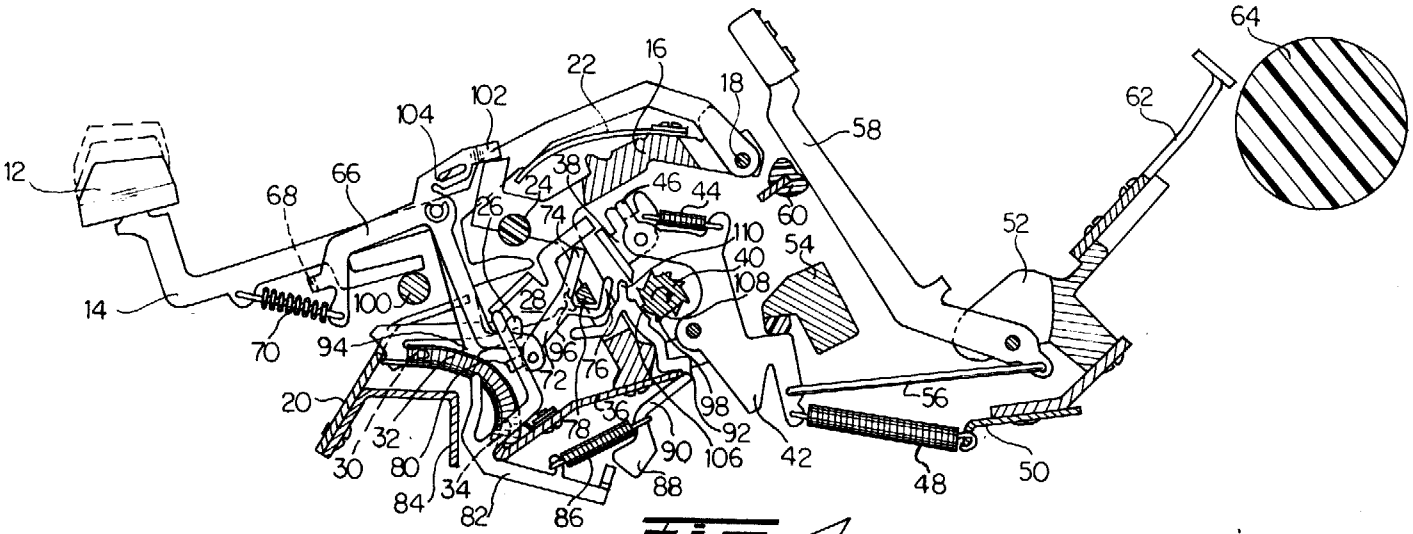
FIG. 4 is a view similar to that of FIG. 3 after further depression of the key to a repeat position.

As shown in FIG. 3, initial depression of the key lever 14 to a single-action position causes a heel 94 on the key lever 14 to push the arcuate coil spring 32 forward (to the left) to pull the single-action interposer 28 until a ledge 96 on the single-action interposer 28 falls off the shelf 78 on the key lever support comb 16. The top of the arcuate coil spring 32 between the heel 94 on the key lever 14 and the prong 30 on the single-action interposer 28 then pivots about the heel 94 and snaps the single-action interposer 28 against the pawl 38 and the pawl 38 counterclockwise against the bent ear 46 on the actuator 42 and against the power roll 40. One of multiple teeth 98 on the power roll 40 engages the pawl 38 to pivot the actuator 42 and (through the link 56) the typebar 58 clockwise to perform a typing operation. Since the nose 26 on the key lever 14 is not, at this stage, in contact with the single-action interposer 28, no irritating jolt can be transmitted back to the key 12 on the key lever 14.

Further depression of the key lever 14 into a lower repeat position is met by increased resistance as the coil tension spring 70 between the key lever 14 and the bell crank 66 joins the cantilever flat spring 22 in offering resistance, and downward movement of the key lever 14 is limited by a space bar shaft 100. As the key lever 14 moves downward, a finger 102 on the bell crank 66 engages the top of the key lever support comb 16 to pivot the bell crank 66 counterclockwise relative to the key lever 14. The repeat key action can be adjusted by insertion of a screwdriver or other suitable tool into a slot 104 in the finger 102 and bending the finger 102 to advance or delay contact of the finger 102 with the top of the key lever support comb 16 and, consequently, to advance or delay movement into the repeat position signaled by initial stretching of the coil tension spring 70 between the key lever 14 and the bell crank 66. As the bell crank 66 pivots counterclockwise, the forked lever 72 pivots about the shelf 78, the upper prong 74 on the forked lever 72 holds the single-action interposer 28 away from the pawl 38, the latch 82 takes over the job of holding the repeat interposer 90 in the rest position, the bent projection 80 on the forked lever 72 engages the latch 82 to unlatch the repeat interposer 90, and the coil tension spring 86 between the repeat interposer 90 and the latch 82 biases and pivots the repeat interposer 90 toward the power roll 40 so that a cam follower surface 106 on the repeat interposer 90 bears against the teeth 98 on the power roll 40.

Figure 5:
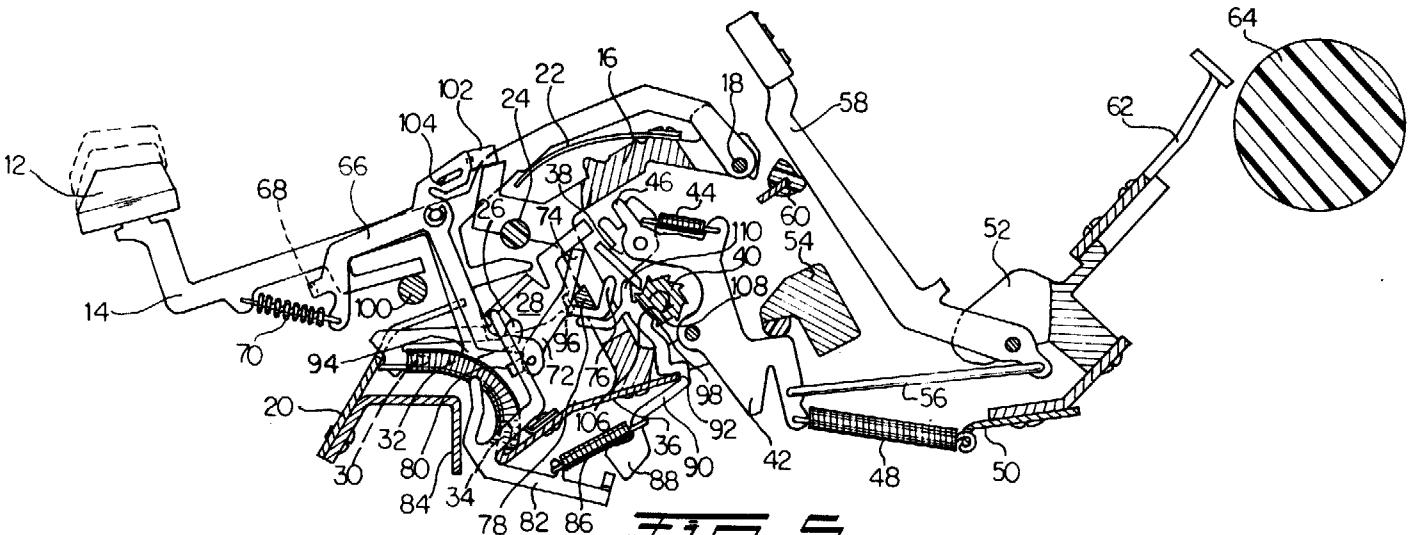
FIG. 5 is a view similar to that of FIG. 4 with the power roll rotated to permit a repeat typing operation.
Figure 5:
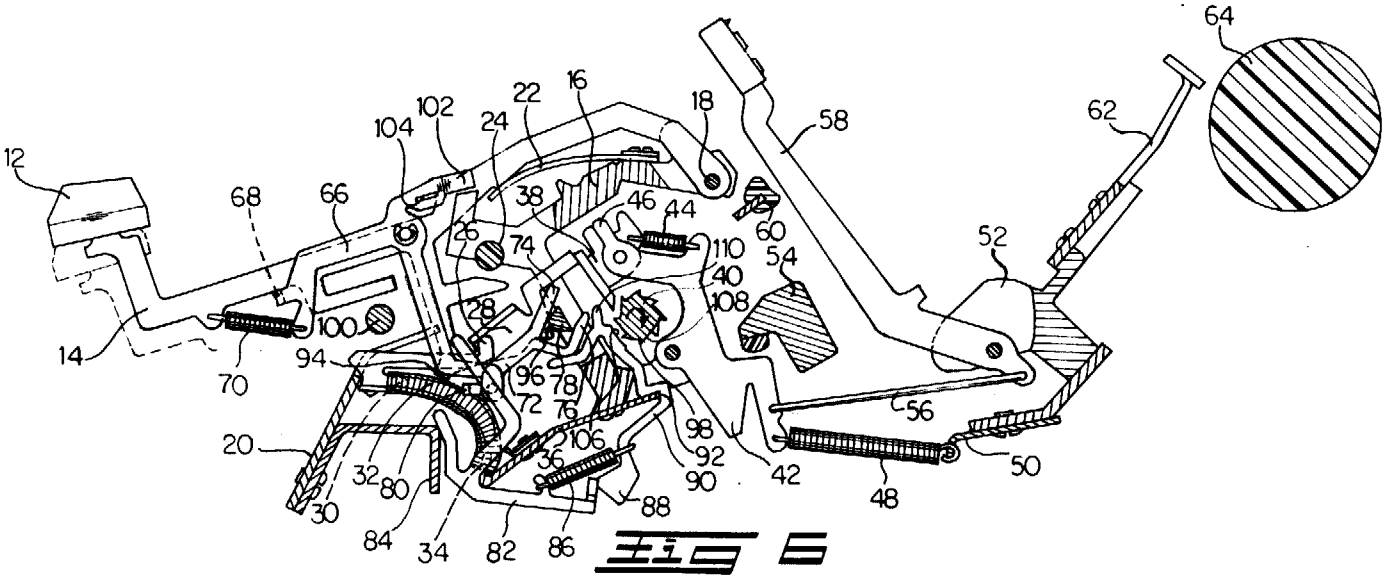

A repeat typing operation is not possible, however, until the cam follower surface 106 on the repeat interposer 90 engages a camming means in the form of a reduced-radius portion or gap 108 between two of the teeth 98 on the power roll 40 as shown in FIG. 5. The camming means could also be, for example, a reduced-radius portion or an increased-radius portion on a cam. The gap 108 is slightly wider than the thickness of the repeat interposer 90. When the cam follower surface 106 engages the gap 108, the rear end 110 of the repeat interposer 90 engages the pawl 38 to pivot the pawl 38 counterclockwise against the bent ear 46 on the actuator 42 and against the power roll 40. The tooth 98 on the power roll 40 adjacent to the clockwise side of the gap 108 engages the pawl 38 to pivot the actuator 42 and (through the link 56) the typebar 58 clockwise to perform a repeat typing operation. Since at this stage the repeat interposer 90 is connected to the rest of the key action by only the coil tension spring 86 between the repeat interposer 90 and the latch 82, no irritating jolt can be transmitted back to the key 12 on the key lever 14. As long as the key lever 14 is held in the repeat position, the rear end 110 of the repeat interposer 90 will initiate a repeat typing operation each time the cam follower surface 106 on the repeat interposer 90 engages the gap 108 on the power roll 40. The gap 108 effectively regulates the speed of the repeat typing operations by permitting only one repeat typing operation during each revolution of the power roll 40. Since the power roll 40 revolves at approximately 585 revolutions per minute (slightly slower while typing), one typing operation per revolution is fast enough.

Upon release of the key 12, the key action begins to return to the rest position as shown in FIG. 6. As the cantilever flat spring 22 lifts the key lever 14, the coil tension spring 70 between the key lever 14 and the bell crank 66 pivots the bell crank 66 clockwise so that the bent projection 80 on the forked lever 72 no longer engages the latch 82. Simultaneously, the lower prong 76 on the forked lever 72 pivots the repeat interposer 90 about the rear edge 92 of the plate 36 to store potential energy in the coil tension spring 86 that is between the repeat interposer 90 and the latch 82, and the repeat interposer 90 again engages the latch 82. As the key lever 14 moves out of the repeat position into the single-action position, the nose 26 on the key lever 14 lifts the single-action interposer 28 to store potential energy in the arcuate coil spring 32 by recocking the arcuate coil spring 32.

Figure 7:
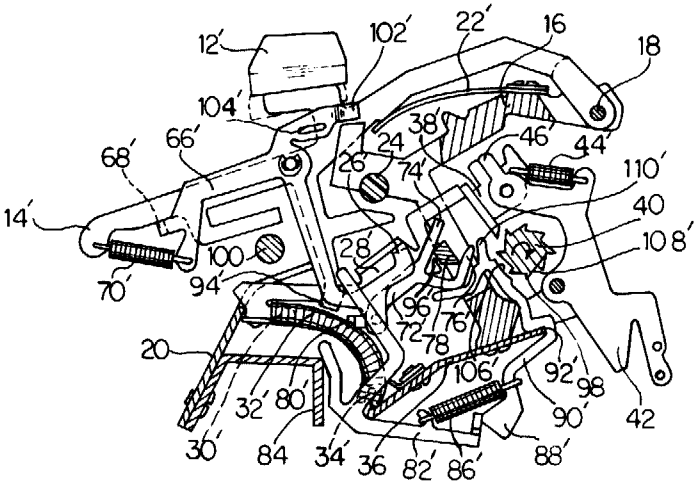
FIG. 7 is a partial view similar to that of FIG. 6, but showing a different key.

Thus far, the key lever 14 that has been described is for a key 12 that is nearest to the operator. Typically, the key 12 would be for a symbol that is often repeated in clusters such as an *x* or a period. FIG. 7 shows a key lever 14' for a key 12' that is farthest from the operator. The key 12' could be for an upper case underline and a lower case hyphen. For ease of comparison, the key action is in the same partially restored position as the key action in FIG. 6, and the same reference numerals have been used, but distinguished by primes for the parts that are not common to the two key actions.

In FIG. 7 the only parts that are shaped differently are the key lever 14' and the bell crank 66'. The key 12' is farther to the rear (to the right) on the key lever 14', and the nose 26' that engages the single-action interposer 28' is on the bell crank 66' instead of on the key lever 14'. The nose 26' contacts the single-action interposer 28' farther to the rear (to the right) than the nose 26 previously described in order to cause the different-length key levers 14 and 14' to trip and restore the single-action interposers 28 and 28' at the same times. The operation and typing characteristics of the key action are the same as that previously described.

Although the invention has been described in its preferred form with a certain degree of particularity, it is understood that the present disclosure of the preferred form has been made by way of example and that numerous changes in the details of construction and the combination and arrangement of parts can be resorted to without departing from the spirit and the scope of the invention as hereinafter claimed.

Having thus set forth the nature of the invention, what is claimed is:

1. In a typing machine of the kind having means for actuating a typing machine operation, a key lever movably mounted in the typing machine, a repeat interposer, means for supporting the repeat interposer, and means for shifting the repeat interposer upon depression of the key lever to a repeat position, in combination, the improvement comprising:

a. a cam follower surface on the repeat interposer;

b. a rotor rotatably mounted in the typing machine; and c. means on the rotor for camming the cam follower surface on the repeat interposer to cause the repeat interposer to engage the actuating means to actuate the typing machine operation at a predetermined time during each revolution of the rotor when the key lever is in the repeat position.

2. The typing machine of claim 1, in which the camming means includes a reduced-radius portion of the rotor.

3. The typing machine of claim 1, in which the rotor has teeth and the camming means includes a gap between two of the teeth.

4. The typing machine of claim 3, in which the actuating means engages the rotor to actuate the typing machine operation.

5. The typing machine of claim 4, further comprising:

d. means for holding the repeat interposer away from the rotor until the key lever is in the repeat position.

6. The typing machine of claim 5, in which the holding means includes a latch for holding the repeat interposer away from the rotor until the key lever is in the repeat position.

7. In a typing machine of the kind having means for actuating a typing machine operation, a power roll rotatably mounted in the typing machine for engagement by the actuating means to actuate the typing machine operation, a key lever movably mounted in the typing machine, a single-action interposer, means for supporting the single-action interposer, and means for shifting the single-action interposer against the actuating means to cause the actuating means to engage the power roll to actuate the typing machine operation upon depression of the key lever to a single-action position, in combination, the improvement comprising:

a. a repeat interposer;

b. means for supporting the repeat interposer for movement independent of the single-action interposer;

c. means for biasing the repeat interposer toward the actuating means;

d. means for holding the repeat interposer away from the actuating means; and e. means for releasing the repeat interposer from the holding means upon depression of the key lever to a repeat position so that the biasing means can bias the repeat interposer toward the actuating means.

8. The typing machine of claim 7, further comprising:

f. a cam follower surface on the repeat interposer; and g. means on the power roll for camming the cam follower surface on the repeat interposer to cause the repeat interposer to engage the actuating means and the actuating means to engage the power roll to actuate the typing machine operation at a predetermined time during each revolution of the power roll when the key lever is in the repeat position.

9. The typing machine of claim 8, in which the power roll has teeth and the camming means includes a gap between two of the teeth.

10. The typing machine of claim 8, in which the holding means includes a latch for holding the repeat interposer away from the actuating means and the power roll until the key lever is in the repeat position.

11. The typing machine of claim 10, in which the biasing means includes a tension spring connected between the repeat interposer and the latch.

12. The typing machine of claim 8, in which the holding means includes a forked lever having a lower prong for holding the repeat interposer away from the actuating means and the power roll when the key lever is in a rest position and the single-action position and an upper prong for holding the single-action interposer away from the actuating means when the key lever is in the repeat position, and further comprising:

h. means for pivoting the forked lever relative to the key lever during depression of the key lever, the forked lever pivotally connected to the pivoting means.

13. The typing machine of claim 12, in which the pivoting means includes a bell crank pivotally connected to the key lever.

14. The typing machine of claim 12, in which the holding means further includes a latch for holding the repeat interposer away from the actuating means and the power roll until the key lever is in the repeat position.

15. In a typing machine of the kind having means for actuating a typing machine operation, a key lever movably mounted in the typing machine, a repeat interposer, means for supporting the repeat interposer, and means for shifting the repeat interposer upon depression of the key lever to a repeat position, the combination comprising:

a rotor rotatably mounted in the typing machine; and means on the rotor and on the repeat interposer upon engagement thereof to cause the repeat interposer to engage the actuating means to actuate the typing machine operation at a predetermined time during each revolution of the rotor when the key lever is in the repeat position.

* * * * *